US008032946B2

(12) United States Patent
Ishikawa

(10) Patent No.: US 8,032,946 B2
(45) Date of Patent: Oct. 11, 2011

(54) SHIELD STRUCTURE FOR HELMET OR GOGGLES, AND HELMET COMPRISING SUCH SHIELD STRUCTURE

(75) Inventor: Michihiko Ishikawa, Katsushika-ku (JP)

(73) Assignee: Shoei Co., Ltd. (JP)

( * ) Notice: Subject to any disclaimer, the term of this patent is extended or adjusted under 35 U.S.C. 154(b) by 437 days.

(21) Appl. No.: 12/409,889

(22) Filed: Mar. 24, 2009

(65) Prior Publication Data

US 2009/0300813 A1 Dec. 10, 2009

(30) Foreign Application Priority Data

Jun. 10, 2008 (JP) ..... 2008-151847

(51) Int. Cl.

| | |
|---|---|
| ***A42B 3/22*** | (2006.01) |
| ***A42B 1/08*** | (2006.01) |
| ***F41H 1/08*** | (2006.01) |
| *F41H 1/04* | (2006.01) |

(52) U.S. Cl. ..... 2/6.5; 2/6.3; 2/6.4; 2/424; 2/410

(58) Field of Classification Search ..... 2/6.3, 6.4, 2/6.5, 6.7, 8.2, 10–13, 15, 426–454, 424, 2/173

See application file for complete search history.

(56) References Cited

U.S. PATENT DOCUMENTS

| | | | | | |
|---|---|---|---|---|---|
| 4,083,065 | A | * | 4/1978 | Warncke | 2/424 |
| 4,297,747 | A | * | 11/1981 | Nava | 2/424 |
| 4,827,537 | A | * | 5/1989 | Villa | 2/410 |
| 5,062,162 | A | * | 11/1991 | Kamata | 2/424 |
| 5,073,990 | A | * | 12/1991 | Kamata | 2/424 |
| 5,088,129 | A | * | 2/1992 | Kamata | 2/411 |
| 5,093,938 | A | * | 3/1992 | Kamata | 2/424 |
| 5,136,728 | A | * | 8/1992 | Kamata | 2/424 |
| 5,161,261 | A | * | 11/1992 | Kamata | 2/424 |
| 5,177,817 | A | * | 1/1993 | Kamata | 2/424 |
| 5,313,665 | A | * | 5/1994 | Luczenbacher et al. | 2/8.3 |
| 5,444,875 | A | * | 8/1995 | Taniuchi | 2/424 |
| 2003/0034071 | A1 | * | 2/2003 | Jackson | 137/489 |
| 2005/0066427 | A1 | | 3/2005 | Gafforio et al. | |
| 2007/0124851 | A1 | * | 6/2007 | Pyo | 2/424 |

FOREIGN PATENT DOCUMENTS

WO WO 01/13750 A1 3/2001

OTHER PUBLICATIONS

Shoei Co., Ltd. Web page, Apr. 23, 2008, located at http://jp.shoei.com/products/ja/parts_list.php?parts_id=1, 3 pages.

* cited by examiner

*Primary Examiner* — Bobby Muromoto, Jr.

(74) *Attorney, Agent, or Firm* — Jones Day

(57) ABSTRACT

The invention provides a shield structure which is compatible for a plurality of helmets in spite that an auxiliary shield mounting mechanism has a comparatively simple structure, is less expensive, and provides a good appearance as a whole. According to one aspect of the invention, each of left and right auxiliary shield mounting mechanisms which are disposed on a main shield includes an inner auxiliary shield mounting portion and outer auxiliary shield mounting portion in common.

16 Claims, 9 Drawing Sheets

SHIELD STRUCTURE FOR HELMET OR GOGGLES, AND HELMET COMPRISING SUCH SHIELD STRUCTURE

TECHNICAL FIELD

The present invention relates to a shied structure for a helmet or goggles, including a main shield and left and right auxiliary shield mounting mechanisms which are disposed on the main shield, in which each of the left and right auxiliary shield mounting mechanisms includes an inner auxiliary shield mounting portion. The present invention also relates to a helmet in which such a shield structure is pivotally mounted on a head protecting body.

The present invention also relates to a shield structure for a helmet or goggles, comprising a main shield and left and right auxiliary shield mounting mechanisms which are disposed on the main shield, in which at least one auxiliary shield mounting mechanism of the left and right auxiliary shield mounting mechanisms comprises an auxiliary shield holding member including an engaging shaft to relatively engage with one of engaging notched recess and an engaging hole of an auxiliary shield and a removal preventive portion to prevent removal of the engaging shaft from one of the engaging notched recess and the engaging hole. The present invention also relates to a helmet in which such a shield structure is pivotally mounted on a head protecting body.

BACKGROUND OF THE INVENTION

In a full-face-type helmet or the like, when a regular shield (to be referred to as a "main shield" in this DESCRIPTION) tends to fog as in the rain, a shield structure is sometimes employed in which an anti-fogging auxiliary shield referred to as an anti-fogging sheet or the like is mounted on the main shield, as disclosed in, e.g., WO 01/13750 A1 (to be referred to as "the prior patent reference" hereinafter). In the helmet shield structure (to be referred to as "the shield structure of the prior patent reference" hereinafter) disclosed in the above prior patent reference, the anti-fogging auxiliary shield is detachably mounted on the inner surface of the main shield to maintain a slight gap with respect to the main shield. In this case, substantially semicircular left and right engaging notched recesses are formed in the left and right ends, respectively, of the anti-fogging inner auxiliary shield. Left and right engaging headed shafts respectively having removal preventive heads for the anti-fogging inner auxiliary shield are disposed on the main shield to correspond to the left and right engaging notched recesses (that is, engaging slits), respectively, such that the headed shafts project on the inner surface of the main shield. Such engaging headed shafts have eccentric shaft structures so that they can adjust the tension of the anti-fogging auxiliary shield with respect to the main shield. Also, the non-eccentric shafts of the engaging headed shafts on the proximal end sides are pivotally inserted in mounting holes of the main shield from the outer surface side of the main shield. The removal preventive heads are fixed to the eccentric shafts. Hence, the tension can be adjusted by pivoting the eccentric shafts.

In the shield structure of the prior patent reference as described above, when mounting the anti-fogging inner auxiliary shield on the inner surface of the main shield, the left and right engaging headed shafts of the main shield are sequentially, relatively engaged with the left and right engaging notched recesses, respectively, of the anti-fogging inner auxiliary shield. This engaging may be done by sequentially, relatively introducing the left and right ends of the anti-fogging inner auxiliary shield into the eccentric shafts existing between the removable preventive heads of the left and right engaging headed shafts and the inner surface of the main shield. When removing the anti-fogging inner auxiliary shield from the main shield, the left and right engaging headed shafts may be sequentially, relatively removed from the left and right engaging notched recesses, respectively, by performing operation reverse to that for engaging. With the shield structure of the prior patent reference having the arrangement as described above, a sealed space serving as a heat-insulating layer can be formed between the outer main shield and the inner anti-fogging auxiliary shield. The heat-insulating layer can serve to decrease the temperature difference between the inner and outer sides of each of the two shields, thus anti-fogging both the main shield and anti-fogging inner auxiliary shield.

In the full-face-type helmet or the like, when the rider travels a bad road as in motocross, the main shield tends to become dirty with mud or the like. For this reason, a shield structure may be used in which one or a plurality of layers of mudguard auxiliary shields each called a mudguard sheet, tear-off film, disposable sheet, or the like are mounted on the outer surface of the main shield such that they can be sequentially removed, as disclosed in the homepage of SHOEI CO., LTD. (http://jp.shoei.com/products/ja/parts_list.php?parts_id=1) (to be referred to as "the prior non-patent reference" hereinafter). In the shield structure (to be referred to as "the shield structure of the prior non-patent reference" hereinafter) for the helmet on which the mudguard outer auxiliary shield is mounted in this manner, left and right engaging holes are formed in the left and right ends, respectively, of the mudguard outer auxiliary shield. Each engaging hole is formed of a substantially circular center hole and a pair of upper and lower slits extending from the center hole outward along the diameter in opposite directions. Left and right engaging headed shafts respectively having removal preventive heads for the mudguard outer auxiliary shield are disposed on the main shield to correspond to the left and right engaging holes, respectively, such that the head shafts project on the outer surface of the main shield. Such engaging headed shafts have eccentric shaft structures so that they can adjust the tension of the mudguard outer auxiliary shield with respect to the main shield. Also, set screws inserted in the mounting holes of the main shield are screwed in the non-eccentric shafts of the engaging headed shafts at the proximal end sides from the inner surface side of the main shield. This fixes the engaging headed shafts to the main shield. Hence, the set screws are loosened by pivoting the engaging headed shafts, the engaging headed shafts and set screws are entirely pivoted by an appropriate amount, and after that the engaging headed shafts are pivoted with respect to the set screws so that the set screws are screwed in and fixed to the engaging headed shafts again. Then, the tension can be adjusted.

In the shield structure of the prior non-patent reference, when mounting the mudguard outer auxiliary shield on the outer side of the main shield, the left and right engaging headed shafts of the main shield are sequentially, relatively engaged with the left and right engaging holes, respectively, of the mudguard outer auxiliary shield. This engagement may be performed by sequentially, relatively inserting the left and right engaging headed shafts into the left and right engaging holes, respectively, of the mudguard outer auxiliary shield which includes one or a plurality of layers.

In the shield structure of the prior non-patent reference described above, when removing the mudguard outer auxiliary shield (if it includes a plurality of layers, the outermost mudguard outer auxiliary shield) dirty with mud or the like from the main shield, the following operation may be performed. More specifically, first, the operator such as the helmet wearer may hold the mudguard outer auxiliary shield at a portion near its left or right end with the hand and pull it substantially forward. In this case, the left or right (in other words, either one) engaging headed shaft of the main shield is extracted relatively from the left or right engaging hole of the mudguard outer auxiliary shield. Subsequently, when the operator further pulls the mudguard outer auxiliary shield substantially forward with his hand, the right or left (in other words, the other) engaging headed shaft of the main shield is also extracted relatively from the right or left engaging hole of the mudguard auxiliary shield. As a result, the mudguard auxiliary shield can be removed from the main shield completely.

Assume that not only the anti-fogging inner auxiliary shield can be mounted on the main shield employed in the shield structure of the prior patent reference having the above arrangement, but also a mudguard outer auxiliary shield can be mounted on the same main shield as in the case of the main shield employed in the shield structure of the prior non-patent reference. Then, one type of main shield structure can be commonly employed in two types of helmets such as the helmet disclosed in the prior patent reference and the helmet disclosed in the prior non-patent reference. The main shield structure becomes compatible, which is preferable. In this case, left and right engaging headed shafts as those disposed on the main shield of the shield structure of the prior non-patent reference may be disposed on the main shield of the shield structure of the prior patent reference as second engaging headed shafts for the mudguard outer auxiliary shield. More specifically, the second engaging headed shafts are disposed on the main shield to project on the outer surface of the main shield. In this case, however, the main shield structure becomes complicated, and the number of components increases, leading to a high cost. In addition, to mount the anti-fogging inner auxiliary shield and mudguard outer auxiliary shield, the main shield is provided with a large number of engaging headed shafts. This degrades the appearance of the main shield (and accordingly the shield structure).

Assume that not only the mudguard outer auxiliary shield can be mounted on the main shield employed in the shield structure of the prior non-patent reference, but also an anti-fogging inner auxiliary shield can be mounted on the same main shield as in the case of the main shield employed in the shield structure of the prior patent reference. Then, one type of main shield structure can be commonly employed in two types of helmets such as the helmet disclosed in the prior non-patent reference and the helmet disclosed in the prior patent reference. The main shield structure becomes compatible, which is preferable. In this case, left and right engaging headed shafts as those disposed on the main shield of the shield structure of the prior patent reference may be disposed on the main shield of the shield structure of the prior non-patent reference as second engaging headed shafts for the anti-fogging inner auxiliary shield. More specifically, the second engaging headed shafts are disposed on the main shield to project on the inner surface of the main shield. In this case, however, the main shield structure also becomes complicated, and the number of components increases, leading to a high cost. In addition, to mount the mudguard outer auxiliary shield and anti-fogging inner auxiliary shield, the main shield is provided with a large number of engaging headed shafts. This degrades the appearance of the main shield (and accordingly the shield structure).

Furthermore, in the case of the shield structure of the prior non-patent reference, when adjusting the tension of the mudguard outer auxiliary shield with respect to the main shield, as described above, the set screws must be loosened by pivoting the engaging headed shafts, the engaging headed shafts and set screws must be entirely pivoted by an appropriate amount, and after that the engaging headed shafts must be pivoted with respect to the set screws so that the set screws are screwed in and fixed to the engaging headed shafts again. This leads to cumbersome tension adjusting operation. In particular, when traveling a bad road on a motorbike as in motocross, the mudguard outer auxiliary shield tends to become dirty with mud or the like. Therefore, if a plurality of layers of mudguard outer auxiliary shields are mounted on the outer surface of the main shield, they must be sequentially removed one by one within a comparatively short time interval. Every time an outer auxiliary shield is to be removed (in other words, within a comparatively short time interval), the tension of a new mudguard outer auxiliary shield existing under the removed mudguard outer auxiliary shield must be adjusted. In this case, adjustment of the tension of the mudguard outer auxiliary shield is further complicated.

SUMMARY OF THE INVENTION

The present invention can correct the above defects in the shield structures of the prior patent reference and prior non-patent reference as described above effectively with a comparatively simple arrangement.

The present invention, in its first aspect, relates to a shield structure for a helmet or goggles, including a main shield and left and right auxiliary shield mounting mechanisms which are disposed on the main shield, each of the left and right auxiliary shield mounting mechanisms including an inner auxiliary shield mounting portion, characterized in that each of the left and right auxiliary shield mounting mechanisms also comprises an outer auxiliary shield mounting portion. According to the first aspect of the present invention, each of left and right auxiliary shield mounting mechanisms comprises an inner auxiliary shield mounting portion and outer auxiliary shield mounting portion in common. Therefore, in spite that the auxiliary shield mounting mechanism has a comparatively simple structure, is less expensive, and provides a good appearance as a whole, either one of the inner auxiliary shield and the outer auxiliary shield can be selectively mounted on the main shield, or both of them can be mounted together on the main shield. Hence, the main shield structure is compatible for a plurality of types of helmets and/or a plurality of types of goggles, which is preferable.

According to the present invention, in the first mode of the first aspect, the inner auxiliary shield mounting portion comprises a first engaging shaft to engage with one of a first engaging notched recess and a first engaging hole of an inner auxiliary shield, and a first removal preventive portion to prevent removal of the first engaging shaft from one of the first engaging notched recess and the first engaging hole, and the outer auxiliary shield mounting portion comprises a second engaging shaft to engage with one of a second engaging notched recess and a second engaging hole of an outer auxiliary shield, and a second removal preventive portion to prevent removal of the second engaging shaft from one of the second engaging notched recess and the second engaging hole. According to the first mode of the first aspect of the present invention, the inner and outer auxiliary shields can be mounted on the main shield easily and reliably.

According to the present invention, in the first case of the first mode of the first aspect, the inner auxiliary shield mounting portion of at least one auxiliary shield mounting mechanism of the left and right auxiliary shield mounting mechanisms can be pivotal with respect to the main shield, and the first engaging shaft can comprise a first engaging eccentric shaft eccentric from a pivot center of the inner auxiliary shield mounting portion. According to this first case, the tension of the inner auxiliary shield with respect to the main shield can be adjusted comparatively easily and reliably.

According to the present invention, in the second case of the first mode of the first aspect, the outer auxiliary shield mounting portion of at least one auxiliary shield mounting mechanism of the left and right auxiliary shield mounting mechanisms can be pivotal with respect to the main shield, and the second engaging shaft can comprise a second engaging eccentric shaft eccentric from a pivot center of the outer auxiliary shield mounting portion. According to this second case, the tension of the outer auxiliary shield with respect to the main shield can be adjusted comparatively easily and reliably.

According to the present invention, in the first and second cases of the first mode of the first aspect, at least one auxiliary shield mounting mechanism of the left and right auxiliary shield mounting mechanisms may comprise the left auxiliary shield mounting mechanism and the right auxiliary shield mounting mechanism.

According to the present invention, in the second mode of the first aspect, at least one auxiliary shield mounting mechanism of the left and right auxiliary shield mounting mechanisms can comprise an auxiliary shield holding member including a second recess-projection engaging portion capable of engaging, by recess-projection engagement, with a first recess-projection engaging portion which is stationary with respect to the main shield, the auxiliary shield holding member can comprise an engaging shaft to relatively engage with one of an engaging notched recess and an engaging hole of an auxiliary shield, and a removal preventive portion to prevent removal of the engaging shaft from one of the engaging notched recess and the engaging hole, at least one auxiliary shield mounting portion of the inner auxiliary shield mounting portion and the outer auxiliary shield mounting portion can comprise the engaging shaft and the removal preventive portion, the auxiliary shield holding member can be pivotal with respect to the main shield, the engaging shaft can comprise an engaging eccentric shaft eccentric from a pivot center of the auxiliary shield holding member, and when the auxiliary shield holding member is moved forward in a direction substantially along the pivot center thereof, the second recess-projection engaging portion can disengage from the first recess-projection engaging portion. According to the second mode of the first aspect of the present invention, in at least one auxiliary shield mounting mechanism, the auxiliary shield holding member is pivoted after it is moved forward in a direction substantially along its pivot center, thus adjusting the tension of the auxiliary shield applied by the engaging eccentric shaft. Therefore, the tension of the auxiliary shield will not be adjusted unexpectedly, and can be adjusted accurately and reliably.

Furthermore, the present invention, in its second aspect, relates to a helmet characterized by comprising a shield structure according to the first aspect which is pivotally mounted on a head protecting body. The second aspect of the present invention can provide a helmet that can have the same effect as that achieved by the first aspect of the present invention.

The present invention, in its third aspect, relates to a shield structure for a helmet or goggles, comprising a main shield and left and right auxiliary shield mounting mechanisms which are disposed on the main shield, at least one auxiliary shield mounting mechanism of the left and right auxiliary shield mounting mechanisms comprising an auxiliary shield holding member including an engaging shaft to relatively engage with one of an engaging notched recess and an engaging hole of an auxiliary shield and a removal preventive portion to prevent removal of the engaging shaft from one of the engaging notched recess and the engaging hole, characterized in that the auxiliary shield holding member comprises a second recess-projection engaging portion capable of engaging, by recess-projection engagement, with a first recess-projection engaging portion which is stationary with respect to the main shield, the auxiliary shield holding member is pivotal with respect to the main shield, the engaging shaft comprises an engaging eccentric shaft eccentric from a pivot center of the auxiliary shield holding member, and when the auxiliary shield holding member is moved forward in a direction substantially along the pivot center thereof, the second recess-projection engaging portion disengages from the first recess-projection engaging portion. The third aspect of the present invention can provide the same effect as that achieved by the second mode of the first aspect of the present invention.

Furthermore, the present invention, in its fourth aspect, relates to a helmet characterized by comprising a shield structure according to the third aspect which is pivotally mounted on a head protecting body. The fourth aspect of the present invention can provide a helmet that can have the same effect as that achieved by the third aspect of the present invention.

In each of the second mode of the first aspect and the third aspect of the present invention, the first recess-projection engaging portion may substantially form an external gear shape, and the second recess-projection engaging portion may substantially form an internal gear shape. The removal preventive portion may also serve as a manipulation tab which substantially forms an external gear shape. At least one auxiliary shield mounting portion of the inner auxiliary shield mounting portion and the outer auxiliary shield mounting portion may comprise the outer auxiliary shield mounting portion.

In each of the first case of the second mode of the first aspect and the first mode of the third aspect of the present invention, each of the left and right auxiliary shield mounting mechanisms can comprise the auxiliary shield holding member including the second recess-projection engaging portion capable of engaging, by recess-projection engagement, with the first recess-projection engaging portion which is stationary with respect to the main shield. Also, according to the first case of the second mode of the first aspect and the first mode of the third aspect of the present invention, in each of the left auxiliary shield mounting mechanism and the right auxiliary shield mounting mechanism, the tension of the auxiliary shield applied by the engaging eccentric shaft can be adjusted. Hence, the tension can be adjusted further accurately and easily.

In each of the second case of the second mode of the first aspect and the second mode of the third aspect of the present invention, at least one auxiliary shield mounting mechanism of the left and right auxiliary shield mounting mechanisms can comprise a support shaft member fitted in a mounting hole of the main shield and mounted on the main shield, a first auxiliary shield holding member relatively, pivotally fitted with an inner circumferential surface of the support shaft member, and a second auxiliary shield holding member relatively, pivotally fitted with an outer circumferential surface of the support shaft member, the first auxiliary shield mounting member can comprise a first engaging shaft to relatively engage with one of a first engaging notched recess and a first engaging hole of one of an inner auxiliary shield and an outer auxiliary shield, and a first removal preventive portion to prevent removal of the first engaging shaft from one of the first engaging notched recess and the first engaging hole, and the second auxiliary shield mounting member can comprise a second engaging shaft to relatively engage with one of a second engaging notched recess and a second engaging hole of one of the outer auxiliary shield and the inner auxiliary shield, and a second removal preventive portion to prevent removal of the second engaging shaft from one of the second engaging notched recess and the second engaging hole. Also, according to the second case of the second mode of the first aspect and the second mode of the third aspect of the present invention, the inner auxiliary shield and the outer auxiliary shield can be mounted on the main shield easily and reliably with a comparatively simple arrangement.

In each of the second case of the second mode of the first aspect and the second mode of the third aspect of the present invention, the inner auxiliary shield may comprise an anti-fogging inner auxiliary shield, and the outer auxiliary shield may comprise a mudguard outer auxiliary shield. Also, at least one auxiliary shield mounting mechanism of the left and right auxiliary shield mounting mechanisms may comprise the left auxiliary shield mounting mechanism and the right auxiliary shield mounting mechanism.

The above, and other, objects, features and advantages of this invention will become readily apparent from the following detailed description thereof which is to be read in connection with the accompanying drawings.

DETAILED DESCRIPTION OF THE INVENTION

One embodiment in which the present invention is applied to the shield structure of a full-face-type helmet will be described in "1. Schematic Arrangement of Helmet as a Whole", "2. Arrangement of Shield Structure", "3. Arrangement of Auxiliary Shield Mounting Mechanism" and "4. Operation of Auxiliary Shield Mounting Mechanism" with reference to the accompanying drawings.

1. Schematic Arrangement of Helmet as a Whole

Figure 1:
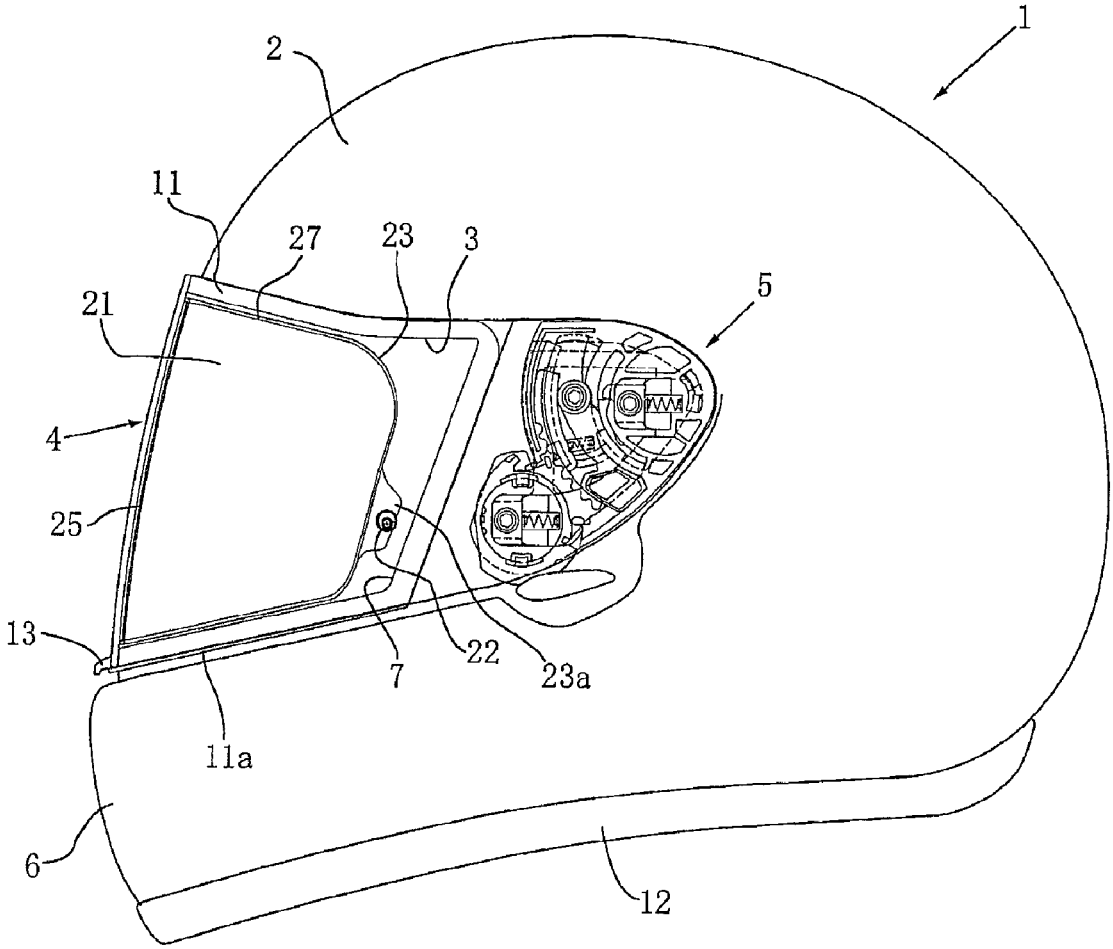
FIG. 1 is a schematic left side view of an entire full-face-type helmet in a state in which an anti-fogging inner auxiliary shield is mounted on the shield structure of the full-face-type helmet according to an embodiment of the present invention.
Figure 2:
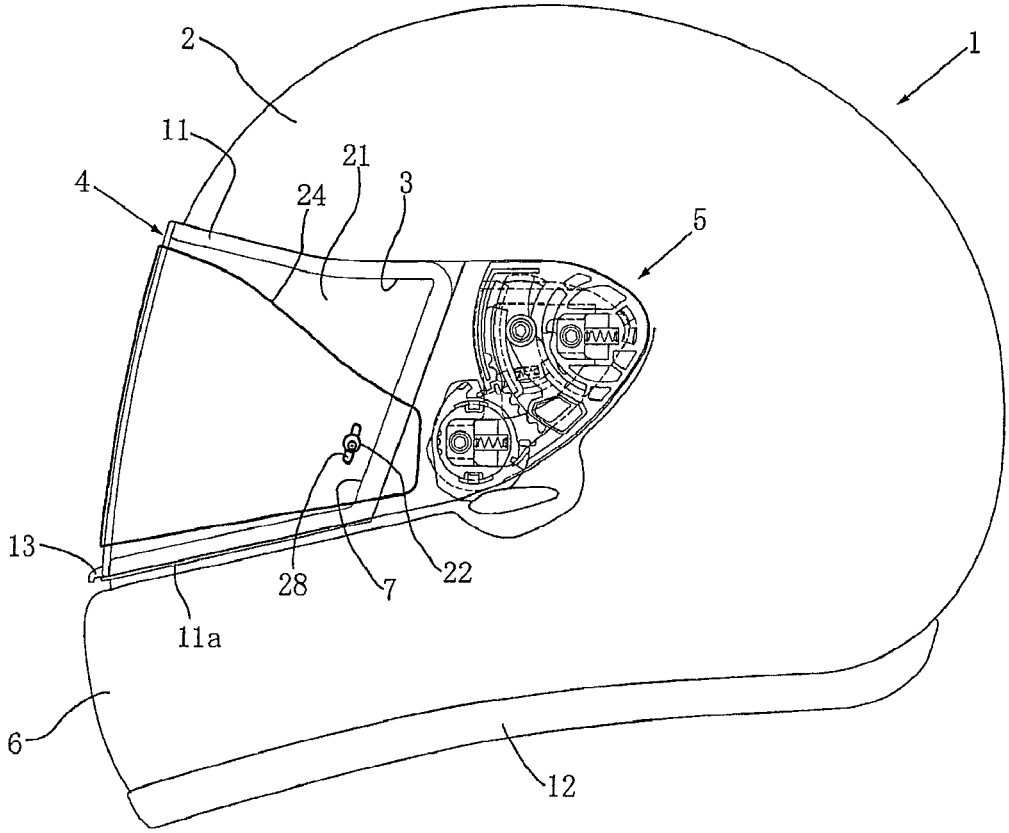
FIG. 2 is a schematic left side view of the entire full-face-type helmet in a state in which a mudguard outer shield is mounted on the shield structure in FIG. 1.

As shown in FIGS. 1 and 2, a full-face-type helmet 1 includes:

(a) a full-face-type head protecting body 2 to be worn on the head of a helmet wearer such as a motorbike rider;

(b) a shield structure 4 capable of opening/closing a window opening 3 formed in the front surface of the head protecting body 2 to oppose a portion between the forehead and chin (i.e., the central portion of the face) of the helmet wearer; and (c) a pair of left and right chin straps (not shown) attached to the inside of the head protecting body 2.

Of the head protecting body 2, each of those portions respectively opposing the chin, forehead and the like of the helmet wearer is provided with one or a plurality of ventilators (not shown), as needed, to ventilate the head protecting body 2. Left and right side portions of the shield structure 4 are pivotally mounted to an outer shell 6 constituting the outer wall of the head protecting body 2, with a pair of left and right shield mounting mechanisms (in other words, main shield mounting mechanisms) 5. The main shield mounting mechanisms 5 are not the main part of the present invention, and accordingly will not be described in detail in this DESCRIPTION.

As is known well, the outer shell 6 can be made of a hard material with large strength such as FRP or another synthetic resin. As shown in FIGS. 1 and 2, a window opening rim member 11 having a substantially U- or E-shaped section or the like is attached to a window opening 7, formed in the outer shell 6 to form the window opening 3 of the head protecting body 2, substantially throughout the entire circumference by adhesion with an adhesive, a double-sided adhesive tape, or the like, as is known well. As shown in FIGS. 1 and 2, a projection 11*a* is continuously formed on the lower end of the window opening rim member 11 along the lower end of the window opening 7 substantially horizontally. The lower end of the shield structure 4, when it is at a full-closing position, abuts against the projection 11*a*. Furthermore, a lower rim member 12 having a substantially U-shaped section or the like is attached to the lower end of the outer shell 6 substantially throughout the entire circumference by adhesion with an adhesive, a double-sided adhesive tape, or the like. As is known well, the window opening rim member 11 can be made of a highly flexible elastic material such as synthetic rubber. As is known well, the lower rim member 12 can be made of a soft material such as foamed vinyl chloride, synthetic rubber, or another soft synthetic resin. In FIGS. 1 and 2, reference numeral 13 denotes a finger rest integrally formed at the lower end of substantially the central portion of the shield structure 4. The helmet wearer places his finger on the finger rest 13 when he wishes to reciprocally pivot the shield structure 4 upward and downward.

2. Arrangement of Shield Structure

As shown in FIGS. 1 and 2, the shield structure 4 basically includes a main shield 21 as the regular shield, and a pair of left and right auxiliary shield mounting mechanisms (in other words, assemblies of auxiliary shield mounting members) 22. The auxiliary shield mounting mechanisms 22 are disposed on the left and right sides of the main shield 21 to oppose the left and right side portions, respectively, of the window opening 3. As shown in FIG. 1, the shield structure 4 can include an anti-fogging inner auxiliary shield 23 detachably mounted on the inner surface of the main shield 21 with the pair of left and right auxiliary shield mounting mechanisms 22. As shown in FIG. 2, the shield structure 4 can also include a mudguard outer auxiliary shield 24 detachably mounted on the outer surface of the main shield 21 with the pair of left and right auxiliary shield mounting mechanisms 22. Left and right side portions of the main shield 21 of the shield structure 4 are pivotally mounted to the outer shell 6 with the pair of left and right shield mounting mechanisms 5. The lower end of the main shield 21 abuts against the projection 11*a* of the window opening rim member 11. The finger rest 13 is integrally formed at the lower end of substantially the central portion of the main shield 21. The main shield 21 is provided to the helmet 1 for the purpose of windshield. If necessary, the main shield 21 may be colored to a degree that does not interfere with transparency, so that it can also serve as a blind (i.e., visor). The main shield 21 can be made of a transparent or translucent hard material such as polycarbonate or anther synthetic resin.

Figure 6:
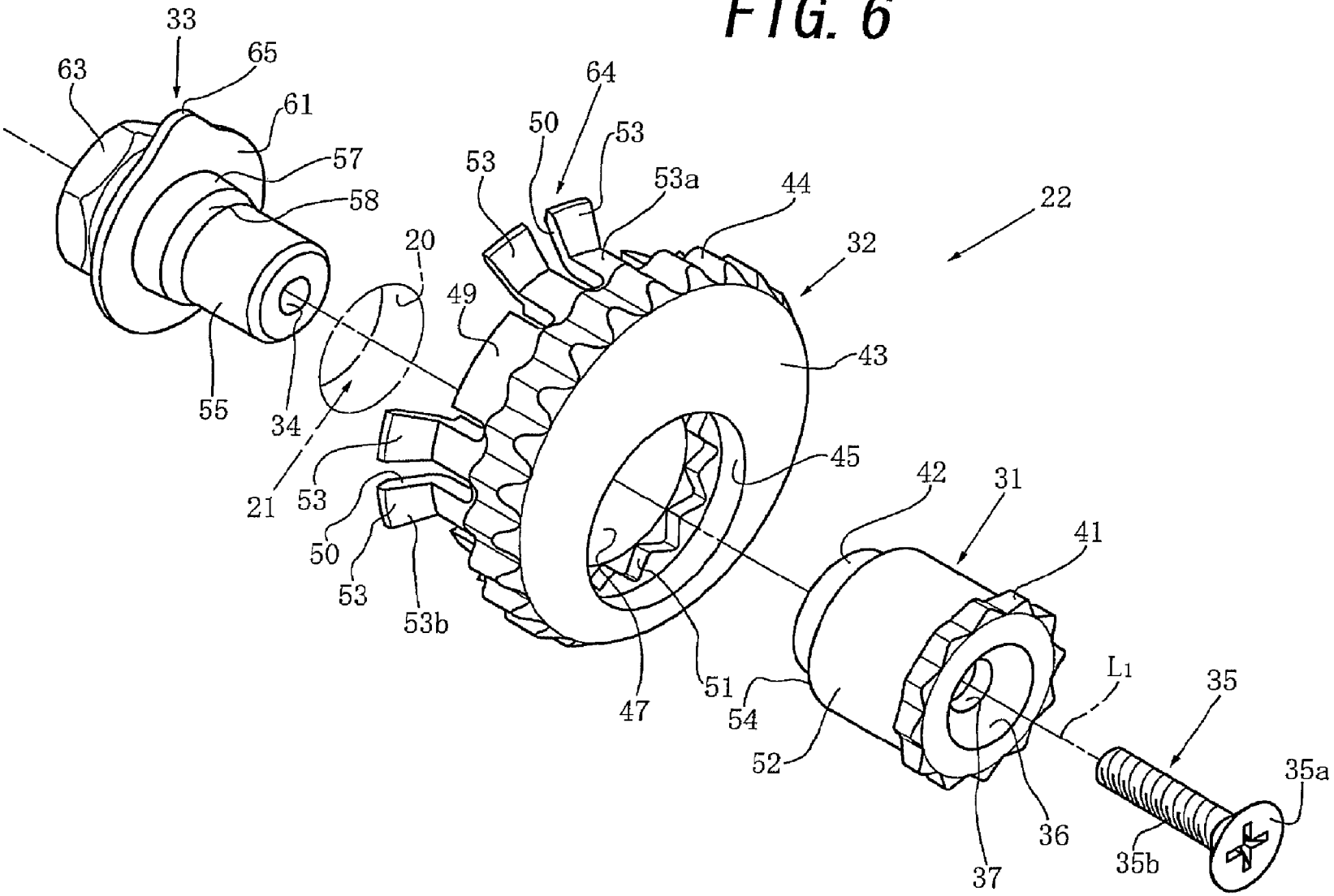
FIG. 6 is an exploded perspective view of the auxiliary shield mounting mechanism in FIG. 3.
Figure 8:
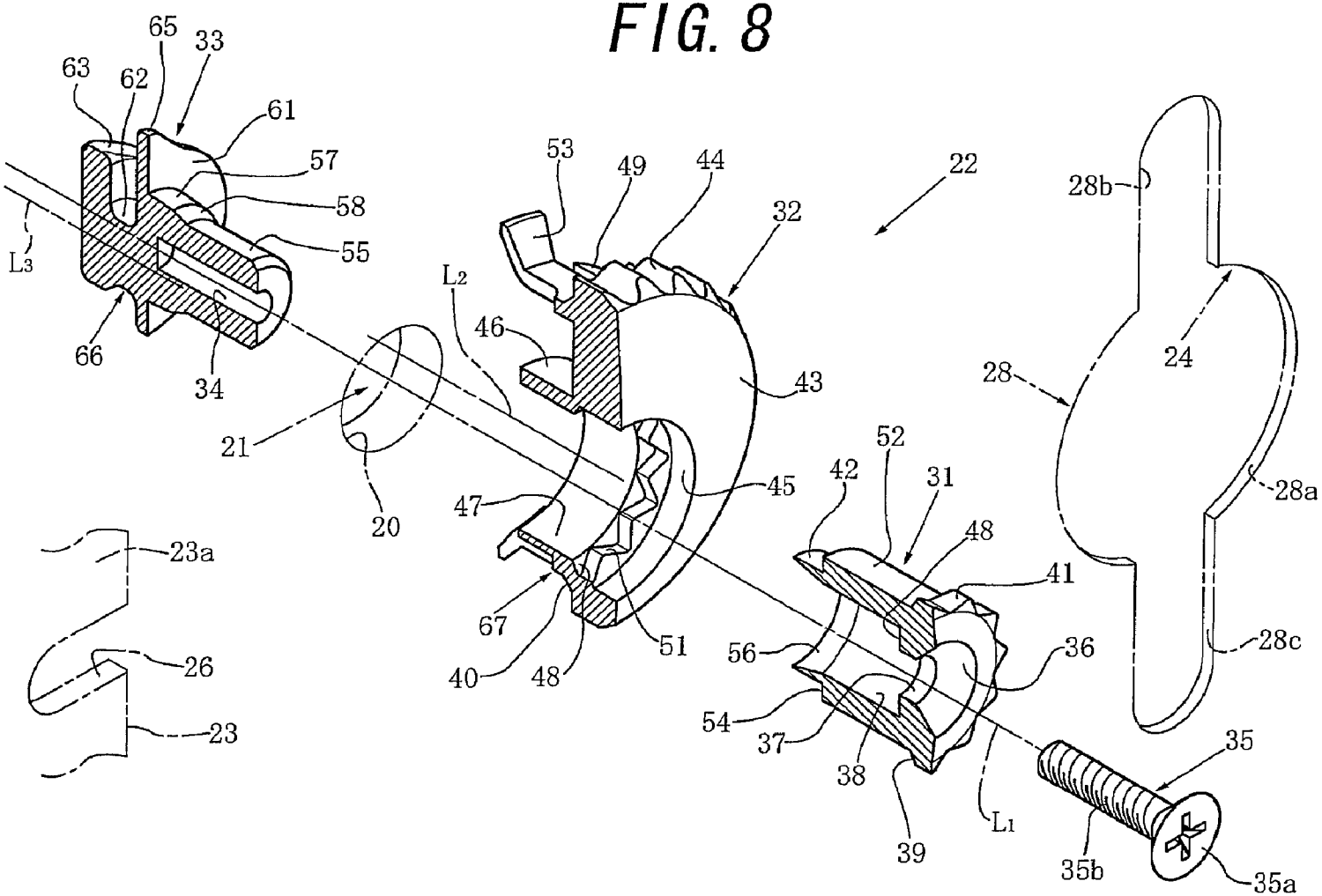
FIG. 8 is a longitudinal sectional exploded perspective view of the auxiliary shield mounting mechanism in FIG. 6.
Figure 12:
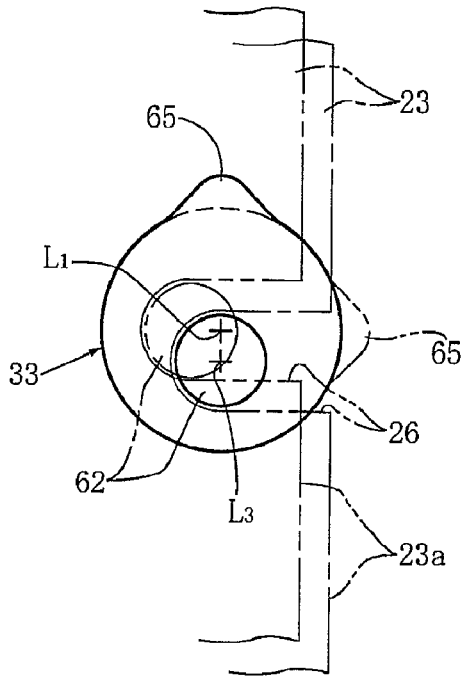
FIG. 12 is a front view schematically showing the positional relationship in the inner auxiliary shield mounting portion shown in FIG. 8 and its operating state.

The anti-fogging inner auxiliary shield 23 shown in FIG. 1 can be made of a transparent or translucent soft or hard material, e.g., a highly hygroscopic resin such as cellulose acetate or cellulose propionate, or another synthetic resin. The anti-fogging inner auxiliary shield 23 is detachably mounted on the main shield 21 to hold a slight gap 25 with respect to the main shield 21. To enable this mounting, a pair of left and right tongue pieces 23*a* project from the left and right ends, respectively, of the anti-fogging inner auxiliary shield 23, at portions slightly under substantially the central portions in substantially the vertical direction. As shown in FIGS. 8 and 12, the pair of left and right tongue pieces 23*a* have a pair of left and right engaging notched recesses 26, respectively, each formed to extend backward and having the shape of a slit, a substantially semicircle, or the like. A packing projecting ridge 27 made of an elastic material such as silicone rubber is formed along the outer circumference of that region of the anti-fogging inner auxiliary shield 23 excluding the pair of left and right tongue pieces 23*a* to substantially form an loop. This allows the anti-fogging inner auxiliary shield 23 to hold the slight gap 25 with respect to the main shield 21 and to maintain the gap 25 airtight. As shown in FIG. 6, the main shield 21 has left and right mounting through holes 20 extending in the direction of thickness to substantially correspond to the left and right engaging notched recesses 26.

The mudguard outer auxiliary shield 24 shown in FIG. 2 can be slightly smaller than the main shield 21 and made of a transparent or translucent soft or hard material such as an olefin resin, propylpylene, or another synthetic resin. The mudguard outer auxiliary shield 24 is mounted to include one or a plurality of layers on the outer surface of the main shield 21 such that they can be sequentially removed. To enable this mounting, the mudguard outer auxiliary shield 24 has left and right engaging holes 28 near its left and right ends. As shown in FIG. 8, each engaging hole 28 is formed of a center hole 28*a* which is, e.g., substantially circular, and a pair of upper and lower slits 28*b* and 28*c* which extend from the center hole 28*a* outward along the diameter in opposite directions (that is, substantially upward and substantially downward). The left and right engaging holes 28 substantially correspond to the left and right mounting holes 20 formed in the main shield 21.

3. Arrangement of Auxiliary Shield Mounting Mechanism

The left auxiliary shield mounting mechanism 22 and the right auxiliary shield mounting mechanism 22 can have substantially the same arrangement. Hence, a description will be made hereinafter on the left auxiliary shield mounting mechanism 22 with reference to FIGS. 3 to 10. This applies to the item of "4. Operation of Auxiliary Shield Mounting Mechanism" as well. FIGS. 3 to 10 show the auxiliary shield mounting mechanism 22 as it is mounted on the main shield 21.

Figure 7:
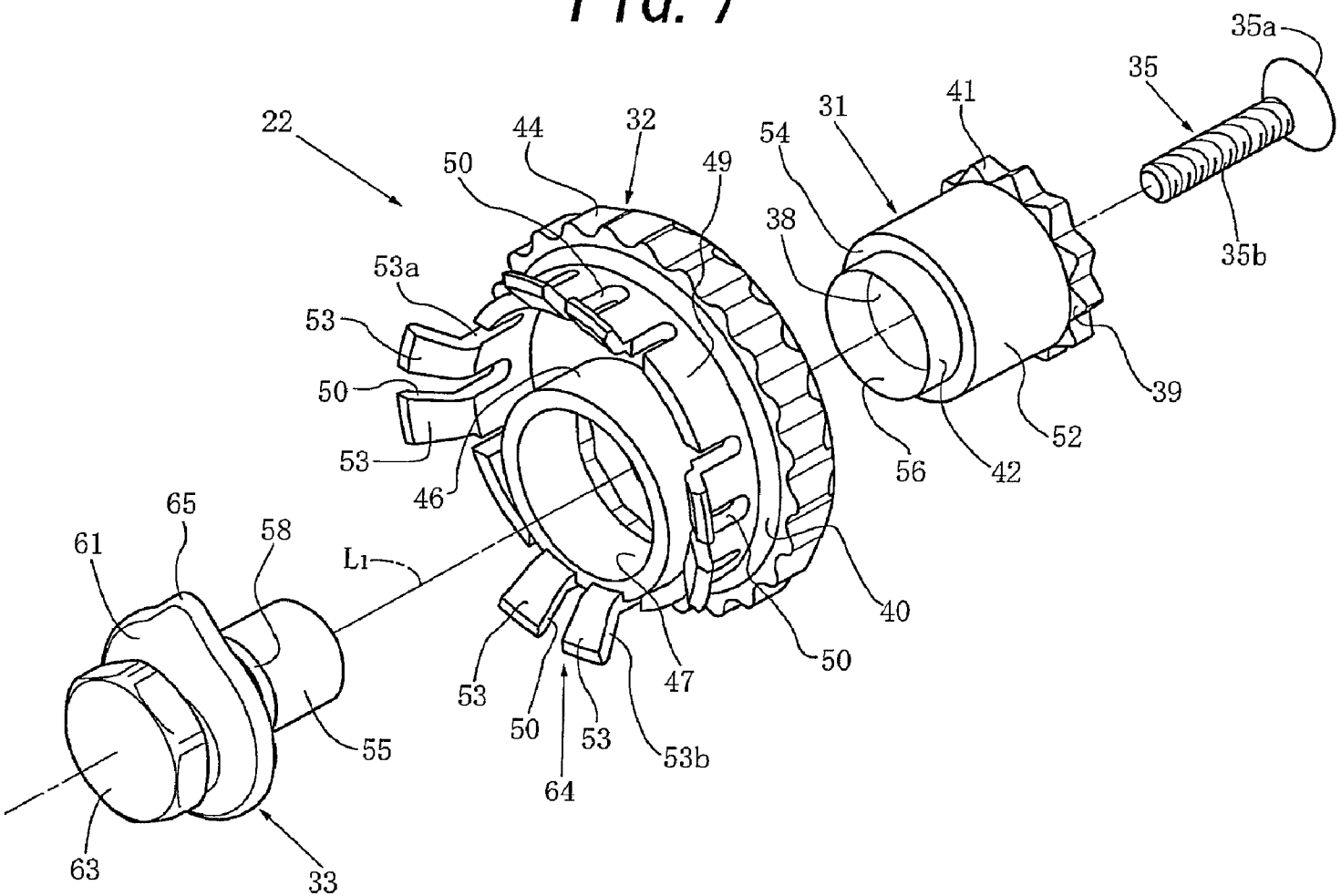
FIG. 7 is a perspective view of the auxiliary shield mounting mechanism in FIG. 6 which is seen from the direction opposite to that of FIG. 6.

As shown in FIGS. 6 and 7, the auxiliary shield mounting mechanism 22 includes:

(a) a support shaft member 31 to be fitted in the mounting hole 20 of the main shield 21 from the outer surface side of the main shield 21 and mounted on the main shield 21, (b) an outer auxiliary shield holding member 32 to be relatively fitted with the outer circumferential surface of the support shaft member 31 from the rear end side of the support shaft member 31, (c) an inner auxiliary shield holding member 33 to be relatively fitted with the inner circumferential surface of the support shaft member 31 from the rear end side of the support shaft member 31, and (d) a screw member 35 such as a phillips head screw to be screwed into a hole or threaded hole 34, formed in the inner auxiliary shield holding member 33 to extend in substantially the direction of diameter of the holding member 33, from the front end side of the holding member 33 by self tap or thread engagement.

In other words, the auxiliary shield mounting mechanism 22 is formed as an assembly of four types of auxiliary shield mounting members including the support shaft member 31, outer auxiliary shield holding member 32, inner auxiliary shield holding member 33 and screw member 35.

As shown in FIG. 8, a fitting recess 36 and screw insertion hole 37 are sequentially formed in the front portion of the support shaft member 31 from the front end side. A head 35*a* of the screw member 35 is to be fitted in the fitting recess 36 from the front end side of the support shaft member 31. A shaft 35*b* of the screw member 35 is to be inserted in the screw insertion hole 37 from the front end side of the support shaft member 31. A fitting hole 38 to fit with the inner auxiliary shield holding member 33 is formed in the support shaft member 31 to extend from the center to the rear portion, such that the fitting hole 38 is continuous to the screw insertion hole 37. An substantially gear-shaped (more specifically, substantially external-gear-shaped) recess-projection engaging portion 41 is formed on the outer circumferential surface of the front end portion of the support shaft member 31 throughout the entire circumference. A thin-walled portion 42 serving as a main shield hold portion is formed at the rear end portion of the support shaft member 31 throughout the entire circumference. The inner circumferential surface of the main shield holding portion 42 forms a circular transcated conical surface 56. The circular transcated conical surface 56 has a substantially circular transcated conical shape with a diameter that gradually decreases from the rear end toward the front end, so as to be continuous with the fitting hole 38 substantially smoothly. Furthermore, a step 54 is formed on the outer circumferential surface of the support shaft member 31 between an axial support portion 52 and the main shield holding portion 42. The step 54 connects the large-diameter axial support portion 52 to the small-diameter main shield holding portion 42. The outer circumferential surface of the main shield holding portion 42 has substantially the same diameter (in other words, forms a substantially columnar surface) in its axial direction.

As shown in FIGS. 6 to 10, the outer auxiliary shield holding member 32 has a substantially button-shaped holding member main body 43. As the diameter of the holding member main body 43 is as small as with a diameter of about 15 mm and a thickness of about 10 mm, a substantially gear-shaped (more specifically, a substantially external-gear-shaped) removal preventive portion (in other words, a removal preventive head) 44 serving as a manipulation tab as well is formed on the outer circumferential surface of the holding member main body 43. Thus, the operator can easily hold the holding member main body 43 with his two fingers. The holding member main body 43 has a hole 45 which is eccentric from the holding member main body 43. Furthermore, the outer auxiliary shield holding member 32 has a cylindrical portion 46 which forms, e.g., a substantially circular cylinder. The cylindrical portion 46 extends from the rear end of the hole 45 of the holding member main body 43 further backward and is substantially concentric with the hole 45. As shown in FIG. 8, the cylindrical portion 46 has a hole 47 with a diameter which is slightly smaller than that of the hole 45 of the holding member main body 43 because of the presence of a step 48.

Figure 9:
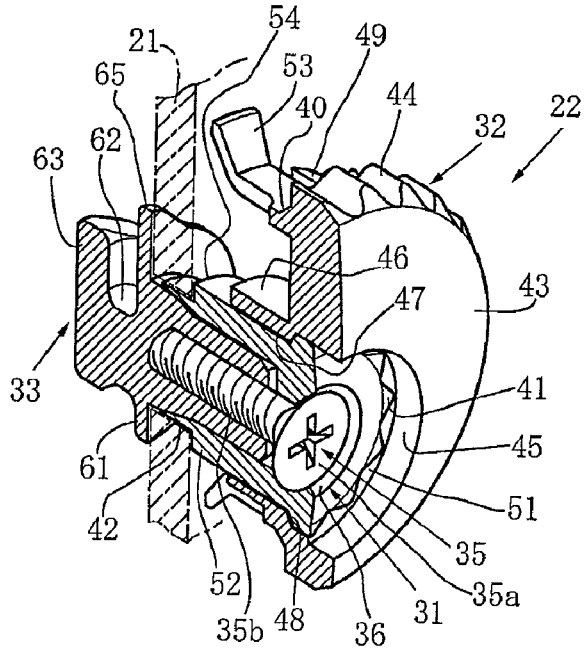
FIG. 9 is a longitudinal sectional perspective view of the auxiliary shield mounting mechanism in FIG. 3.
Figure 10:
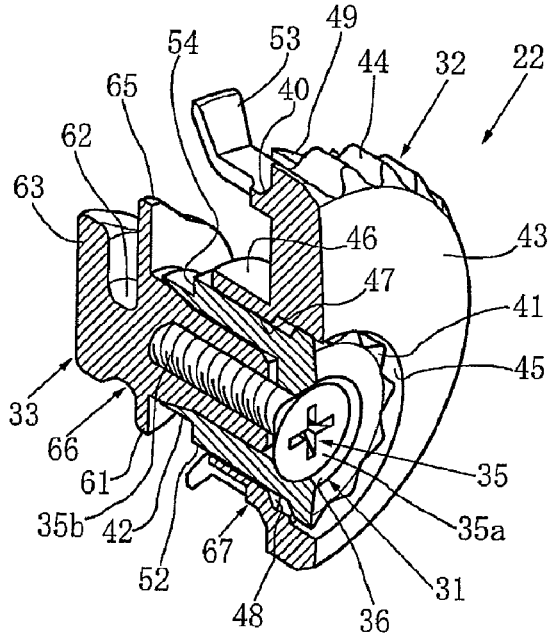
FIG. 10 is a longitudinal sectional perspective view of the auxiliary shield mounting mechanism in FIG. 4.

The inner circumferential surface of the hole 45 of the holding member main body 43 has a substantially gear-shaped (more specifically, substantially internal-gear-shaped) recess-projection engaging portion 51 to be adjacent to the step 48 from the front end side of the step 48. The inner circumferential surface of the recess-projection engaging portion 51 has substantially the same shape as that of the outer circumferential surface of the recess-projection engaging portion 41 of the support shaft member 31. When the support shaft member 31 is fitted in the holes 45 and 47 of the outer auxiliary shield holding member 32 from the front end side of the holding member 32, the holding member main body 43 substantially opposes the recess-projection engaging portion 41 of the support shaft member 31, and the cylindrical portion 46 substantially opposes the axial support portion (that is, the portion between the recess-projection engaging portion 41 and thin-walled holding portion 42) 52 of the support shaft member 31, as shown in FIGS. 9 and 10. As shown in FIG. 7, a substantially cylindrical auxiliary shield holding portion (in other words, an auxiliary shield engaging shaft or engaging eccentric shaft) 49 with a diameter slightly smaller than that of the holding member main body 43 is formed on the rear surface of the holding member main body 43 to be integral with the holding member main body 43. Hence, a substantially ring-like step 40 is formed between the holding member main body 43 and auxiliary shield holding portion 49. Also, the engaging eccentric shaft 49 and removal preventive head portion 44 form a headed engaging shaft. The auxiliary shield holding portion 49 has a plurality of slits 50 extending from the rear end of the holding portion 49 to near the step 40 in substantially the radial direction of the outer auxiliary shield holding member 32. More specifically, four sets of slits 50, each set including relatively close three slits 50, are formed in the auxiliary shield holding portion 49 substantially equidistantly (in other words, to be shifted from each other by substantially 90°). Proximal portions 53*a* of two comparatively thin-walled springs 53 are formed among the slits 50 of each set. Distal ends 53*b* outwardly extending from the proximal portions 53*a* obliquely backward are continuously formed on the distal end sides of the two proximal portions 53*a*, respectively. Hence, the large number of comparatively thin-walled springs 53 are integrally formed with the holding member main body 43 along the outer circumference. Each spring 53 forms a substantially L shape so it extends from the rear surface of the holding member main body 43 substantially backward and opens outward to extend obliquely backward.

The inner auxiliary shield holding member 33 includes an axially supported portion 55 to extend from the front portion toward the center of the inner holding member 33. The axially supported portion 55 is to be fitted in the fitting hole 38 of the support shaft member 31 from the rear end side of the fitting hole 38. The rear end portion of the outer circumferential surface of the axially supported portion 55 forms a circular transcated conical surface 57. The circular transcated conical surface 57 has a substantially circular transcated conical shape with a diameter that gradually decreases from the rear end toward the front end, so as to substantially correspond to the inner circumferential surface of the main shield holding portion 42 of the support shaft member 31. A second circular transcated conical surface 58 having a shape similar to a so-called step is formed at the front end of the circular transcated conical surface 57. The axially supported portion 55 has the hole or threaded hole 34, formed at the front end of the inner auxiliary shield holding member 33, in the form of a blind hole to extend in the axial direction of the axially supported portion 55.

As shown in FIG. 8, the inner auxiliary shield holding member 33 has a partition wall 61 formed integral with the axially supported portion 55 to be substantially adjacent to the rear end of the circular transcated conical surface 57. The holding member 33 also has an engaging eccentric shaft (in other words, an engaging shaft) 62 formed integral with the partition wall 61 to be substantially adjacent to the rear end of the partition wall 61. The engaging eccentric shaft 62 has a removal preventive portion (in other words, a removal preventive head) 63, serving as a manipulation tab as well, formed at the rear end of the engaging eccentric shaft 62 to be integral with it. The removal preventive portion 63 constitutes the head of the engaging eccentric shaft 62. The engaging eccentric shaft 62 and removal preventive portion 63 constitute the headed engaging shaft in the shield structure of the prior patent reference. As the removal preventive portion 63 is as small as with a maximum diameter of about 6 mm, it can form a flat polygon such as a flat hexagon, so the operator can hold it easily. The screw member 35 is inserted in the fitting recess 36 and screw insertion hole 37 from the front end side of the support shaft member 31, and then screwed into the hole or threaded hole 34 of the inner auxiliary shield holding member 33. As shown in FIG. 7, an indicator 65 projects from the partition wall 61 to indicate the tension of the inner auxiliary shield 23 applied by the holding member 33. When the indicator 65 is directed upward or downward, it indicates that the tension of the inner auxiliary shield 23 applied by the holding member 33 is adjusted to a substantially intermediate state.

Assume that the axial directions of the support shaft member 31 and screw member 35 coincide with a center line (in other words, a common center line) $L_1$. In this case, the axes of the hole 45 of the outer auxiliary shield holding member 32, the recess-projection engaging portion 51, the step 48 and the cylindrical portion 46 substantially coincide with the common center line $L_1$ of the auxiliary shield mounting mechanism 22, as shown in FIG. 8. The axial direction of the mounting hole 20 of the main shield 21 also coincides with the common center line $L_1$. The axial directions of the axially supported portion 55 of the inner auxiliary shield holding member 33, the threaded hole 34, the partition wall 61 and the removal preventive portion 63 serving as the manipulation tab as well also substantially coincide with the common center line $L_1$. In contrast to this, the axes of the holding member main body 43 of the outer auxiliary shield holding member 32, the tab 44 and a spring mechanism 64 which is formed of the large number of springs 53 into a substantially cylindrical shape as a whole substantially coincide with a center line (that is, a first eccentric center line) $L_2$, eccentric from the common center line $L_1$, for the outer auxiliary shield 24. The axis of the engaging eccentric shaft 62 of the inner auxiliary shield holding member 33 substantially coincides with a center line (that is, a second eccentric center line) $L_3$, eccentric from the common center line $L_1$, for the inner auxiliary shield 23. Note that the distance of eccentricity of the first eccentric center line $L_2$ from the common center line $L_1$ (in other words, the distance between the common center line $L_1$ and first eccentric center line $L_2$) can fall within a range of ½ to 4 times the distance of eccentricity of the second eccentric center line $L_3$ from the common center line $L_1$ (in other words, the distance between the common center line $L_1$ and second eccentric center line $L_3$), and is about 2 times in the embodiment shown in FIG. 8.

4. Operation of Auxiliary Shield Mounting Mechanism

An example of a procedure for mounting the auxiliary shield mounting mechanism 22 on the main shield 21 will be described in the following items (a) to (d).

Figure 3:
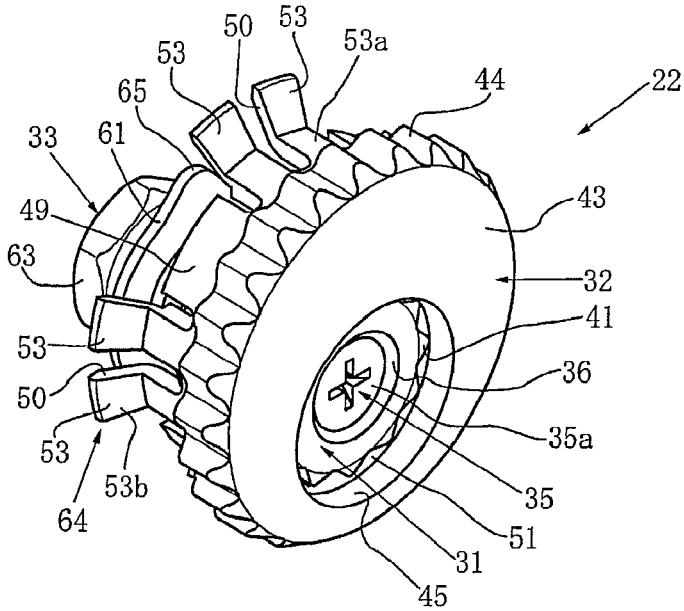
FIG. 3 is a perspective view of an auxiliary shield mounting mechanism in FIG. 1 in which an outer auxiliary shield mounting portion is in a pivot-locked state.
Figure 4:
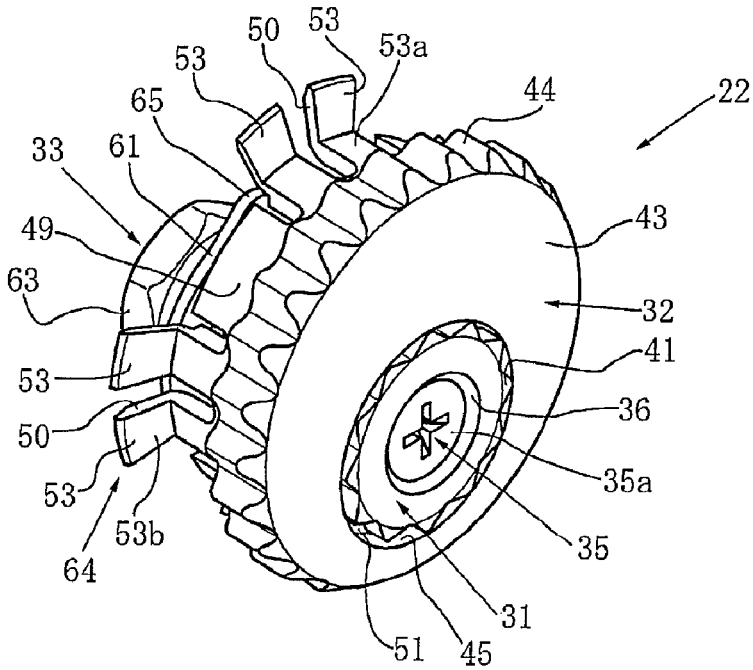
FIG. 4 is a perspective view of the auxiliary shield mounting mechanism in FIG. 3 in which the outer auxiliary shield mounting portion is in a pivot-unlocked state.
Figure 5:
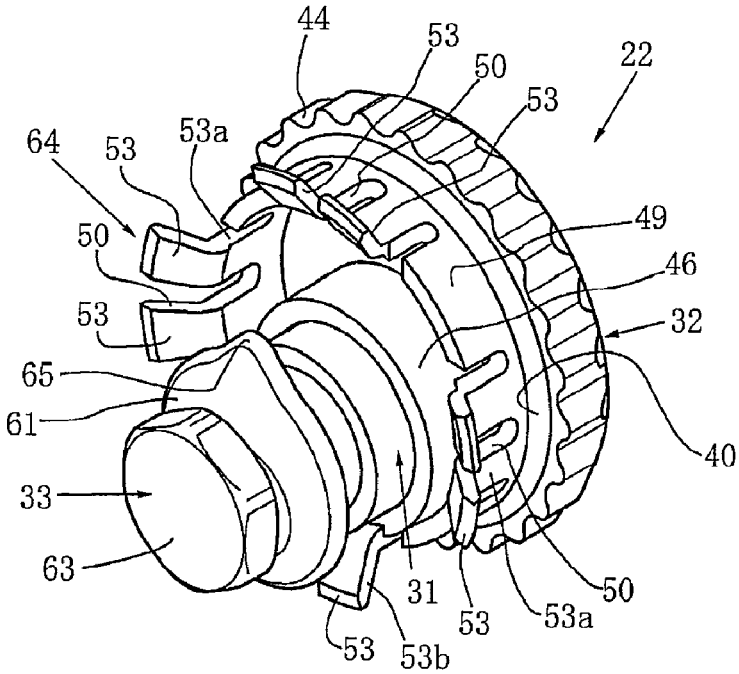
FIG. 5 is a perspective view of the auxiliary shield mounting mechanism in FIG. 3 which is seen from the direction opposite to that of FIG. 3.

(a) First, as shown in FIG. 10, the support shaft member 31 is relatively fitted in the holes 45 and 47 of the outer auxiliary shield holding member 32 from the front end side of the hole 45. In this case, preferably, the recess-projection engaging portion 41 of the support shaft member 31 is engaged with the recess-projection engaging portion 51 of the holding member 32 so that the holding member 32 is set in a pivot-locked state (in other words, in a pivot-disabled state) with respect to the support shaft member 31, as shown in FIGS. 3 and 9. The rear end face (that is, the step) 39 of the recess-projection engaging portion 41 of the support shaft member 31 can substantially abut against the step 48 of the holding member 32.

(b) Subsequently, as shown in FIG. 9, the thin-walled portion (in other words, the main shield holding portion) 42 of the support shaft member 31 is relatively fitted in the mounting holes 20 of the main shield 21 from the rear end side of the main shield holding portion 42. In this case, preferably, the front face of the main shield 21 is substantially abutted against the step 54 of the support shaft member 31.

(c) Subsequently, as shown in FIG. 10, the axially supported portion 55 of the inner auxiliary shield holding member 33 is relatively fitted in the fitting hole 38 of the support shaft member 31 from the front end side of the axially supported portion 55. In this case, preferably, the front face of the partition wall 61 of the holding member 33 is substantially abutted against the rear face of the main shield 21.

(d) Subsequently, as shown in FIG. 10, the screw member 35 is screwed into the hole or threaded hole 34 of the inner auxiliary shield holding member 33 from the front end side of the holding member 33 by self tap or thread engagement. Because of this screwing, the main shield holding portion 42 of the support shaft member 31 rides over the circular transcated conical surfaces 58 and 57 of the holding member 33 sequentially. This increases the inner and outer diameters of the thin main shield holding portion 42. Consequently, the outer circumferential surface of the main shield holding portion 42 is strongly pressed against the circumferential surface of the mounting hole 20 of the main shield 21. This prevents the support shaft member 31 (and accordingly the entire auxiliary shield mounting mechanism 22) from idling with respect to the mounting hole 20. Simultaneously, the main shield 21 is firmly fixed between the step 54 of the support shaft member 31 and the front face of the partition wall 61 of the inner auxiliary shield holding member 33. This fixes the auxiliary shield mounting mechanism 22 to the main shield 21 firmly. Also, friction engagement of the main shield holding portion 42 of the support shaft member 31 with the circular transcated conical surface 57 of the holding member 33 becomes firm. As the main shield 21 relatively presses the distal end 53*b* of the spring 53 of the outer auxiliary shield holding member 32, the outer auxiliary shield holding member 32 is biased forward. Hence, the step 48 is elastically press-mounted on a step 39 of the support shaft member 31.

An example of a procedure for mounting the anti-fogging inner auxiliary shield 23 to the left and right auxiliary shield mounting mechanisms 22 mounted on the main shield 21 as shown in FIG. 1 will be described in the following items (e) and (f).

Figure 11:
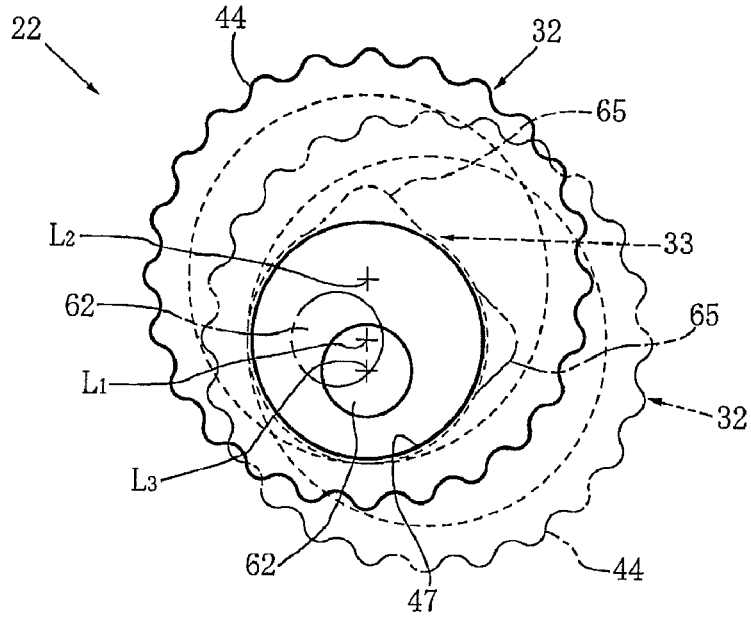
FIG. 11 is a front view schematically showing the positional relationship between an inner auxiliary shield mounting portion and outer auxiliary shield mounting portion shown in FIG. 8 and their operating states.

(e) First, as shown in FIGS. 11 and 12, the engaging eccentric shafts 62 of the inner auxiliary shield holding members 33 of the left and right auxiliary shield mounting mechanisms 22 are sequentially, relatively introduced into the left and right engaging notched recesses 26 (see FIG. 8), respectively, of the anti-fogging inner auxiliary shield 23, thus relatively inserting or fitting them. In this case, the auxiliary shield 23 engages with the engaging eccentric shafts 62 at the engaging notched recesses 26.

(f) Assume that the operator wishes to adjust the tension of the anti-fogging inner auxiliary shield 23 mounted on the main shield 21 as described in the above item (e). In this case, first, the operator slightly screws back the screw member 35 of the left and/or right auxiliary shield mounting mechanism 22 from the hole or threaded hole 34 of the inner auxiliary shield holding member 33. Then, the operator holds the removal preventive head portion 63 serving as the manipulation tab as well of the holding member 33 with his two fingers and pivots the removal preventive portion 63 counterclockwise or clockwise through an appropriate angle, thus adjusting the tension of the inner auxiliary shield 23. Then, the operator screws the screw member 35 again sufficiently into the hole or threaded hole 34.

In the shield structure 4 having the arrangement as described above, a sealed space serving as a heat-insulating layer is formed between the outer main shield 21 and inner anti-fogging auxiliary shield 23. This heat-insulating layer can serve to decrease the temperature difference between the inner and outer sides of each of the two shields 21 and 23, thus anti-fogging the main shield 21 and anti-fogging inner auxiliary shield 23. When removing the anti-fogging inner auxiliary shield 23 from the main shield 21, the left and right engaging eccentric shafts 62 may be sequentially, relatively removed from the left and right engaging notched recesses 26, respectively, by performing operation reverse to that for mounting described in the above item (e). Hence, each of the left and right auxiliary shield mounting mechanisms 22 includes an inner auxiliary shield mounting portion 66 formed of the engaging eccentric shaft (in other words, the inner shield engaging shaft) 62 and the removal preventive head portion (in other words, the inner shield removal preventive portion) 63 serving as the manipulation tab as well.

An example of a procedure for mounting the mudguard outer auxiliary shield 24 to the left and right auxiliary shield mounting mechanisms 22 mounted on the main shield 21 as shown in FIG. 2 will be described in the following items (g) and (h).

Figure 13:
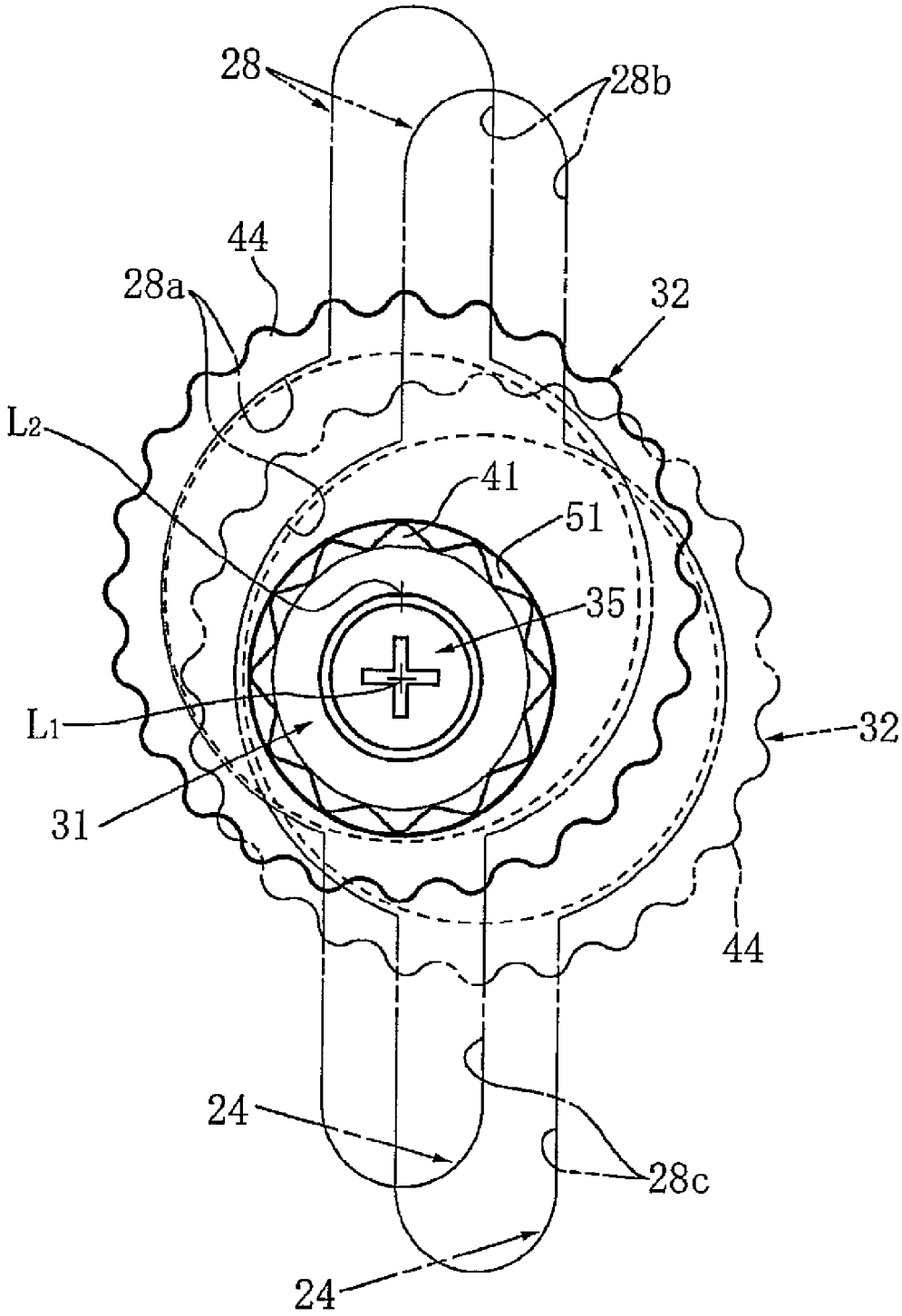
FIG. 13 is a front view schematically showing the positional relationship in the outer auxiliary shield mounting portion shown in FIG. 8 and its operating state.

(g) First, as shown in FIGS. 11 and 13, the holding member main bodies 43 (in other words, the removal preventive portions 44) of the outer auxiliary shield holding members 32 of the left and right auxiliary shield mounting mechanisms 22 are sequentially, relatively inserted in the left and right engaging holes 28 (see FIG. 8) of one or the plurality of layers of mudguard outer auxiliary shields 24. In this case, the auxiliary shield 24 relatively engages with the auxiliary shield holding portion 49 at its engaging hole 28.

(h) When the operator wishes to adjust the tension of the mudguard outer auxiliary shield 24 mounted on the main shield 21 as described in the above item (g), first, he holds the removal preventive head portion 44 serving also as the manipulation tab of the outer auxiliary shield holding member 32 of the left and/or right auxiliary shield mounting mechanism 22 with his two fingers and pushes it in toward the main shield 21. Accordingly, the large number of springs 53 (in other words, the substantially cylindrical spring mechanism 64) of the holding member 32 are strongly urged against the outer surface of the main shield 21 and are further elastically deformed. Hence, the removal preventive head portion 44 serving also as the manipulation tab moves forward (in other words, moves backward) toward the main shield 21. The recess-projection engaging portion 51 of the holding member 32, which relatively engages with the recess-projection engaging portion 41 of the support shaft member 31 so it is prohibited from pivoting with respect to the support shaft member 31, also moves forward from the recess-projection engaging portion 41 toward the main shield 21. Thus, the recess-projection engaging portion 51 is disengaged from the recess-projection engaging portion 41 and set in a state pivotal with respect to the support shaft member 31 (in other words, in a pivot-unlocked state). Subsequently, the operator pivots the removal preventive head portion 44 serving also as the manipulation tab of the holding member 32 counterclockwise or clockwise through a predetermined angle while holding it with his two fingers, thus adjusting the tension of the outer auxiliary shield 24. After that, the operator releases his fingers from the manipulation tab 44. Note that the recess-projection engaging portion 41 is slightly tapered from the front side toward the rear side (in other words, from the recess-projection engaging portion 41 side toward the axial support portion 52 side). Therefore, upon release of the fingers as described above, even if the recess-projection engaging portion 41 is slightly misaligned from the recess-projection engaging portion 51 in the pivoting direction, it can reliably engage with the recess-projection engaging portion 51 by the elastic restoration force of the large number of springs 53. Even if the recess-projection engaging portion 41 and recess-projection engaging portion 51 are misaligned from each other and do not engage with each other, they can be engaged well with each other by pivoting the manipulation tab 44 slightly.

When the operator wishes to remove the mudguard outer shields 24 from the main shield 21 one by one, he may perform the following operation. More specifically, first, the operator pulls the outermost mudguard outer auxiliary shield 24 substantially forward by holding a portion of it which is close to the left or right end. In this case, the left or right removal preventive head portion 44 of the main shield 21 is relatively extracted from the left or right engaging hole 28 of the mudguard outer auxiliary shield 24. Subsequently, when the operator further pulls the mudguard outer auxiliary shield 24 substantially forward with his hand, the right or left removal preventive head portion 44 of the main shield 21 is also relatively extracted from the right or left engaging hole 28 of the mudguard outer auxiliary shield 24. Hence, where necessary, the mudguard outer auxiliary shields 24 can be completely removed one by one from the main shield 21.

Hence, each of the left and right auxiliary shield mounting mechanisms 22 includes an outer auxiliary shield mounting portion 67 formed of the engaging eccentric shaft (in other words, the outer shield engaging shaft) 46 and the removal preventive head portion (in other words, the outer shield removal preventive portion) 44 serving as the manipulation tab as well. In spite that the left and right auxiliary shield mounting mechanisms 22 are separate mounting mechanisms, they include the inner auxiliary shield mounting portion 66 and outer auxiliary shield mounting portion 67 in common. According to the left and right auxiliary shield mounting mechanisms 22, with the anti-fogging inner auxiliary shield 23 being mounted as shown in FIG. 1 with the procedure described in the above items (e) and (f), when the mudguard outer auxiliary shield 24 is mounted as shown in FIG. 2 with the procedure described in the above items (g) and (h), both the inner and outer auxiliary shields 23 and 24, which are separate members, can be mounted on the single main shield 21 together.

Having described a specific preferred embodiment of this invention with reference to the accompanying drawings, it is to be understood that the invention is not limited to that precise embodiment, and that various changes and modifications may be effected therein by one skilled in the art without departing from the scope or spirit of the invention as defined in the appended claims.

For example, in the embodiment described above, the present invention is applied to the shield structure 4 of the full-face-type helmet 1. However, the present invention can also be applied to the shield structure of a full-face-type helmet serving also as a jet-type helmet in which the chin cover can be raised, a jet-type helmet, a semi-jet-type helmet, or the like, and the shield structure of goggles.

In the above embodiment, the support shaft member 31 is formed separately of the main shield 21. Alternatively, the support shaft member 31 can be formed integrally with the main shield 21.

In the above embodiment, the spring mechanism 64 substantially having the tubular shape such as a cylindrical shape is formed integrally with the outer auxiliary shield holding member 32. Alternatively, the spring mechanism 64 can be a spring mechanism such as a coil spring formed separately of the holding member 32, or any other elastic biasing means.

In the above embodiment, the left and right auxiliary shield mounting mechanisms 22 are disposed on the main shield 21. However, the number of auxiliary shield mounting mechanisms 22 to be disposed on the main shield 21 need not be two. Another auxiliary shield mounting mechanism 22 can also be disposed near the upper and/or lower end of the center of the main shield 21.

In the above embodiment, the inner auxiliary shield 23 serves as an anti-fogging member, and the outer auxiliary shield 24 serves as a mudguard member. However, the inner and outer auxiliary shields 23 and 24 need not have these functions. For example, the outer auxiliary shield 24 may serve as an anti-fogging member, and the inner auxiliary shield 23 may serve as a mudguard member.

In the above embodiment, the recess-projection engaging portion 41 of the support shaft member 31 and the recess-projection engaging portion 51 of the outer auxiliary shield holding member 32 form substantially gear shapes (in other words, a substantially external-gear shape and a substantially internal-gear shape, respectively) each having a large number of projections and a large number of recesses. Alternatively, either one of the pair of recess-projection engaging portions 41 and 51 may have a large number of projections, and the remaining one of the pair of removal preventive portions 44 and 51 may have a large number of recesses corresponding to the large number of projections, respectively. It suffices as far as the pair of recess-projection engaging portions 41 and 51 can engage with each other by recess-projection engagement.

In the above embodiment, the inner auxiliary shield 23 is provided with the pair of left and right engaging notched recesses 26, and the outer auxiliary shield 24 is provided with the pair of left and right engaging holes 28. Alternatively, the inner auxiliary shield 23 can be provided with the left and/or right engaging hole 28, and the outer auxiliary shield 24 can be provided with the left and/or right engaging notched recess 26.

Furthermore, in the above embodiment, the holding member 32 serves as the outer auxiliary shield, and the holding member 33 serves as the inner auxiliary shield. Alternatively, the front and rear sides of the auxiliary shield mounting mechanism 22 may be reversed, so that the holding member 32 serves as the inner auxiliary shield and the holding member 33 serves as the outer auxiliary shield.

The invention claimed is:

1. A shield structure for a helmet or goggles, comprising a main shield and left and right auxiliary shield mounting mechanisms which are disposed on said main shield, at least one auxiliary shield mounting mechanism of said left and right auxiliary shield mounting mechanisms comprising an auxiliary shield holding member including an engaging shaft to relatively engage with one of an engaging notched recess and an engaging hole of an auxiliary shield and a removal preventive portion to prevent removal of said engaging shaft from one of the engaging notched recess and the engaging hole, wherein:

said auxiliary shield holding member comprises a second recess-projection engaging portion capable of engaging, by recess-projection engagement, with a first recess-projection engaging portion which is stationary with respect to said main shield, said auxiliary shield holding member is pivotal with respect to said main shield, said engaging shaft comprises an engaging eccentric shaft eccentric from a pivot center of said auxiliary shield holding member, and when said auxiliary shield holding member is moved forward in a direction substantially along the pivot center thereof, said second recess-projection engaging portion disengages from the first recess-projection engaging portion.

2. A structure according to claim 1, wherein:

the first recess-projection engaging portion substantially forms an external gear shape, and the second recess-projection engaging portion substantially forms an internal gear shape.

3. A structure according to claim 1, wherein:

said removal preventive portion also serves as a manipulation tab which substantially forms an external gear shape.

4. A structure according to claim 1, wherein:

said at least one auxiliary shield mounting portion of said inner auxiliary shield mounting portion and said outer auxiliary shield mounting portion comprises said outer auxiliary shield mounting portion.

5. A structure according to claim 1, wherein:

each of said left and right auxiliary shield mounting mechanisms comprises said auxiliary shield holding member including the second recess-projection engaging portion capable of engaging, by recess-projection engagement, with the first recess-projection engaging portion which is stationary with respect to said main shield.

6. A structure according to claim 1, wherein:

at least one auxiliary shield mounting mechanism of said left and right auxiliary shield mounting mechanisms comprises a support shaft member fitted in a mounting hole of said main shield and mounted on said main shield, a first auxiliary shield holding member relatively, pivotally fitted with an inner circumferential surface of said support shaft member, and a second auxiliary shield holding member relatively, pivotally fitted with an outer circumferential surface of said support shaft member, said first auxiliary shield mounting member comprises a first engaging shaft to relatively engage with one of a first engaging notched recess and a first engaging hole of one of an inner auxiliary shield and an outer auxiliary shield, and a first removal preventive portion to prevent removal of said first engaging shaft from one of the first engaging notched recess and the first engaging hole, and said second auxiliary shield mounting member comprises a second engaging shaft to relatively engage with one of a second engaging notched recess and a second engaging hole of one of the outer auxiliary shield and the inner auxiliary shield, and a second removal preventive portion to prevent removal of said second engaging shaft from one of the second engaging notched recess and the second engaging hole.

7. A structure according to claim 6, wherein:

the inner auxiliary shield comprises an anti-fogging inner auxiliary shield, and the outer auxiliary shield comprises a mudguard outer auxiliary shield.

8. A structure according to claim 6, wherein:

at least one auxiliary shield mounting mechanism of said left and right auxiliary shield mounting mechanisms comprises said left auxiliary shield mounting mechanism and said right auxiliary shield mounting mechanism.

9. A helmet comprising a shield structure according to claim 1 which is pivotally mounted on a head protecting body.

10. A shield structure for a helmet or goggles, comprising:

a main shield;

an inner auxiliary shield;

an outer auxiliary shield; and left and right auxiliary shield mounting mechanisms, each of which has an inner portion including a pivotal eccentric inner shaft for mounting the inner auxiliary shield on the main shield and an outer portion including a pivotal eccentric outer shaft for mounting the outer auxiliary shield on the main shield.

11. A shield structure as defined in claim 10 wherein each of the left and right auxiliary shield mounting mechanisms includes a spring mechanism compressively engaged between the main shield and the respective outer portion.

12. A shield structure as defined in claim 11 wherein each outer shaft has a central axis, and each spring mechanism includes a plurality of springs that are spaced apart circumferentially about the respective central axis.

13. A shield structure as defined in claim 10 wherein the main shield has a left mounting through hole and a right mounting through hole, and wherein each of the left and right auxiliary shield mounting mechanisms extends through a respective mounting through hole in the main shield, with each inner portion projecting inward from the respective through hole, and with each outer portion projecting outward from the respective through hole.

14. A shield structure as defined in claim 13 wherein each through hole has a central axis, each inner shaft has a central axis that is offset from the central axis of the respective through hole at a first distance of eccentricity, and each outer shaft has a central axis that is offset from the central axis of the respective through hole at a second distance of eccentricity.

15. A shield structure as defined in claim 14 wherein the first and second distances of eccentricity are unequal.

16. A shield structure as defined in claim 15 wherein the first distance of eccentricity is less than the second distance of eccentricity.

* * * * *